US005954236A

United States Patent [19]

Virnelson

[11] Patent Number: 5,954,236

[45] Date of Patent: Sep. 21, 1999

[54] MULTI-COMPONENT DISPENSER

[76] Inventor: Robert Craig Virnelson, 8696 Ranch Dr., Chesterland, Ohio 44026

[21] Appl. No.: 09/040,566

[22] Filed: Mar. 18, 1998

[51] Int. Cl.[6] ..... B67D 5/52; B67D 5/56; B67D 25/08

[52] U.S. Cl. ..... 222/135; 222/129; 206/219

[58] Field of Search ..... 222/129, 135, 222/145.1, 145.4, 252, 256, 260; 206/219, 220, 221

[56] References Cited

U.S. PATENT DOCUMENTS

| | | | |
|---|---|---|---|
| 4,014,463 | 3/1977 | Hermann | 222/145 |
| 4,029,236 | 6/1977 | Carson, Jr. et al. . | |
| 4,050,612 | 9/1977 | Stone . | |
| 4,220,261 | 9/1980 | White | 222/135 |
| 5,310,091 | 5/1994 | Dunning et al. . | |
| 5,333,760 | 8/1994 | Simmen . | |
| 5,339,990 | 8/1994 | Wilder . | |
| 5,372,283 | 12/1994 | Schmitkons et al. . | |
| 5,405,056 | 4/1995 | Mills . | |
| 5,409,140 | 4/1995 | Camm et al. . | |
| 5,462,203 | 10/1995 | Stern . | |
| 5,499,745 | 3/1996 | Derian et al. . | |
| 5,564,600 | 10/1996 | Renault | 222/129 |
| 5,702,182 | 12/1997 | Alvarado | 366/130 |

FOREIGN PATENT DOCUMENTS

| | | |
|---|---|---|
| 0624403 | 3/1994 | European Pat. Off. . |
| 2708574 | 8/1993 | France . |

*Primary Examiner*—Andres Kashnikow
*Assistant Examiner*—Keats Quinalty
*Attorney, Agent, or Firm*—Ralph E. Jocke

[57] ABSTRACT

A multi-component dispenser (10) for dispensing at least a first fluid product (23) and a second fluid product (27) from a container (12) includes at least a first chamber (14) and a second chamber (16) situated axially therein. A conduit (32) fluidly communicates the second chamber (16) with nozzle (30) that also receives the first fluid product (23) from the first chamber (14). The rear wall (26) of the second chamber (16) includes an extension member (42) for providing substantially synchronous movement of rear wall (22) of the first chamber with rear wall (26) of the second chamber for dispensing the two fluids generally simultaneously. A hole (44) provided in side wall (18) allows air to flow into the void between the first and second chambers (14,16) to facilitate dispensing the two fluid products (23,27). Flexibility in design of the multi-component dispenser (10) allows the diameter of the first chamber to be reduced or enlarged for varying mix ratios of the first fluid product with the second fluid product.

20 Claims, 3 Drawing Sheets

MULTI-COMPONENT DISPENSER

TECHNICAL FIELD

This invention relates in general to a dispenser for discharging a plurality of fluid components. Specifically, this invention relates to a multi-component dispenser which maintains at least two fluid products separate and allows them to be discharged in a preset amount and mixed through a nozzle of the dispenser.

BACKGROUND ART

There are many types of dispensers that are available for dispensing a plurality of fluid components. These fluid components include chemically reactive resins, a resin and a hardener, various sealants, caulk, even toothpaste, etc. One such dispenser that is widely commercially available includes a typical caulking gun ordinarily used for dispensing various types of single component materials such as caulk or silicone sealants.

U.S. Pat. No. 5,310,091 describes a dual product dispenser particularly suited for dispensing and mixing a pair of fluid products such as chemically reactive resins. The dual product dispenser employs a fixed hollow delivery tube extending through the interior of the front chamber that receives a post mounted on the rear wall of the rear chamber. As a force is applied to the rear chamber, the dispenser dispenses two fluid products as the forward movement of the rear chamber moves an annular disc shaped piston to force a first fluid product out of the forward chamber. A rear partition wall spaced from the inside surface of the cylindrical wall functions as a piston for forcing a second fluid product out from the rear chamber. A partial vacuum is created by the sliding engagement between chamber walls for making a "suck back" effect to reduce unwanted dripping from the nozzle.

U.S. Pat. No. 4,220,261 also discloses a dual dispenser but one which provides for an air intake to prevent the formation of a vacuum during operation.

Another patent of interest is French Patent 2,708,574 which shows a dispenser with a first component enclosed in a first chamber and a second component enclosed in a second chamber. Both chambers fluidly communicate with their respective nozzles. The first chamber is bounded by an outer wall which includes a channel extended about its base. The second chamber is also bounded by an inner wall but includes a helical thread extending its entire length. The second chamber which is also bounded by a top wall can be moved through the first chamber as the inner wall is rotated to cause the helical thread to pass through the channel.

Still other examples of various dispensers are described in the following patents: U.S. Pat. No. 5,462,203; U.S. Pat. No. 5,409,140; U.S. Pat. No. 5,405,056; U.S. Pat. No. 5,372,283; U.S. Pat. No. 5,339,990; U.S. Pat. No. 5,499,745; U.S. Pat. No. 5,333,760; U.S. Pat. No. 5,332,124; U.S. Pat. No. 4,014,463; U.S. Pat. No. 4,029,236; U.S. Pat. No. 4,050,612; and U.S. Pat. No. 3,208,645.

There still exists a need for a multi-component dispenser that is simple in design and economical to manufacture. Preferably, such a dispenser would include a single container wall and not require separate containers for each component. A conduit would allow fluid communication between the second chamber and a nozzle that also receives fluid product from the first chamber. An extension member would allow for substantially a synchronous discharge of the two fluid products from both chambers. Additionally, the multi-component dispenser would include the flexibility to allow for more than two chambers in applications where three or more fluid products require mixing in specific amounts. The conduit may be divided and extended to allow for fluid communication while at the same time maintaining the fluid products separate in individual chambers.

DISCLOSURE OF INVENTION

It is an object of the present invention to provide a multi-component dispenser that allows a first fluid product contained within a first chamber to be maintained separate from a second fluid product contained within a second chamber and dispensed generally simultaneously together with a single discharge nozzle.

It is a further object of the present invention to provide a multi-component dispenser that allows filling a pair of separate chambers with at least two distinct fluid products which may be even chemically reactive when mixed together.

It is a further object of the present invention to provide a multi-component dispenser that dispenses at least two fluid products in preset amounts that may be mixed during discharge from the dispenser through the nozzle.

It is a further object of the present invention to provide a multi-component dispenser that allows one force to be applied on the most rearward chamber to synchronously dispense at least two fluid products from their respective chambers in desired amounts where they are mixed in a nozzle attached to the dispenser.

It is a further object of the present invention to provide a multi-component dispenser constructed for dispensing a sealant or resin in which two reactive components are dispensed at a desired ratio through a static mixer nozzle that requires only a standard dispensing gun like a caulking gun for example.

It is a further object of the present invention to provide a multi-component dispenser that includes an opening within its sidewall to allow air to flow into the dispenser as the two fluid products are being discharged.

It is a further object of the present invention to provide a conduit that is hollow and divided to allow for three or more fluid products within their respective chambers.

It is a further object of the present invention to provide a multi-component dispenser which is simple in design and economical to manufacture.

It is a further object of the present invention to provide a multi-component dispenser with a reusable design.

It is a further object of the present invention to provide a multi-component dispenser for medical applications such as a syringe for example.

Further objects of the present invention will be made apparent following the Best Modes for Carrying out Invention and the appended claims.

The foregoing objects of the present invention are accomplished with a container that is preferably cylindrical in shape and suited for a typical caulking gun. It is equally applicable to a structure such as a syringe type dispenser for medical applications. The term syringe type dispenser is meant to include a syringe or a syringe like device for dispensing medication directly into a patient or dispensing into another container or vial. The container includes at least a first and a second chamber with each of the chambers having an interior space or volume that is defined by a front wall, side walls, a slidably movable rear wall. The front wall of the first chamber which is the front of the container includes a nozzle that is preferably a static mixer nozzle centrally located in the front of the container. The nozzle surrounds an opening in the front wall to the first chamber. It should be understood that the nozzle in the medical application may be a needle. A conduit is positioned within the first chamber and is axially aligned with the nozzle. The conduit passes through the front wall of the second chamber to fluidly connect the second chamber with the nozzle. Preferably, the conduit is generally semi-circular in shape and centrally located within the container along with the nozzle. The rear wall of the first chamber includes an aperture that is constructed to provide a relatively tight, yet sliding, engagement of the rear wall of the first chamber on the conduit for movement thereon when a force is applied.

The multi-component dispenser in accordance with the present invention includes an extension member attached to the rear wall of the second chamber. The extension member is constructed to pass through an opening in the front wall of the second chamber in a relatively tight, yet sliding, engagement such that when a force is applied to the rear wall of the second chamber the extension member passes through the opening in the front wall of the second chamber to cause a generally synchronous movement of the rear wall of the first chamber so that a first fluid product is discharged substantially simultaneously with a second fluid product contained within the second chamber.

The multi-component dispenser in accordance with the present invention further includes an alternate embodiment with a first chamber having a diameter smaller or less than the second chamber to allow for pre-calculated variable mix ratios for a selected first fluid product with the second fluid product. In a similar fashion, the present invention allows the second chamber to have a diameter that is smaller than or less than the first chamber.

In addition, the multi-component dispenser in accordance with the present invention includes an extension member that may be either solid or hollow. The extension member preferably has a semi-circular shape. The present invention includes the option of providing for a third chamber by simply dividing the conduit which also has preferably a semi-circular shape in half and extending the quarter section further into a third chamber similarly constructed to the first two chambers. While previous multi-component dispensers normally require separate containers for the components, one advantage of the present invention is that a single tubular container may be segmented with front and rear walls for defining the chambers and a conduit provided to allow for fluid communication between the chambers and the discharge nozzle. An extension member provides generally synchronous movement of the rear walls of each chamber for substantially simultaneous discharge of the fluid products at any desired ratio.

BEST MODES FOR CARRYING OUT INVENTION

Figure 1:
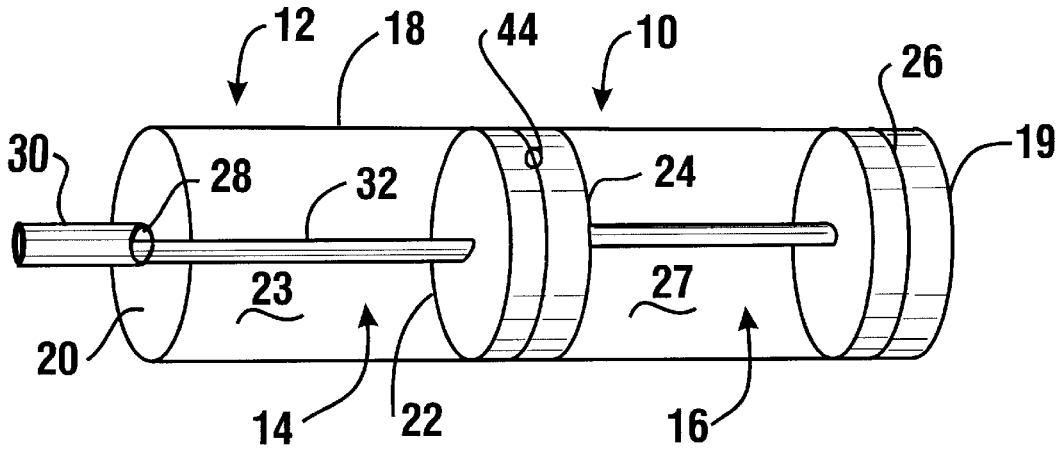
FIG. 1 is an elevated view with sections removed of a multi-component dispenser in accordance with the present invention showing the dispenser in a full position.

Referring to the drawings where like numerals designate like or similar features throughout the several views, and first in particular to FIG. 1, there is shown a multi-component dispenser generally designated 10 according to the present invention. Preferably, the multi-component dispenser 10 is generally cylindrical in shape and constructed to be used in a typical caulking gun (not shown). It should be immediately apparent that the multi-component dispenser 10 may be of such construction that it can be utilized with any dispenser capable of applying a linear force for operation whether that force is manual, pneumatic, hydraulic, mechanical through threading means or otherwise. One such example is for medical applications like a syringe, the present invention may be used to dispense at least two medications simultaneously through the needle of the syringe.

Multi-component dispenser 10 comprises container 12 being of a generally cylindrical shape that has a first chamber 14 axially aligned with a second chamber 16. Preferably, chambers 14, 16 are formed by a cylindrical tubular container with side walls 18 and each chamber having front and rear walls. First chamber 14 has front wall 20 which may be formed integrally with container 12 side walls 18, and a rear wall 22. Cylindrical side walls 18 extend throughout the length of container 12 and terminate in an open rear end 19 and at front wall 20. Side walls 18 together with the front wall 20 and rear wall 22 define the first chamber 14 which has an interior volume or space for holding a first fluid product 23.

Figure 2:
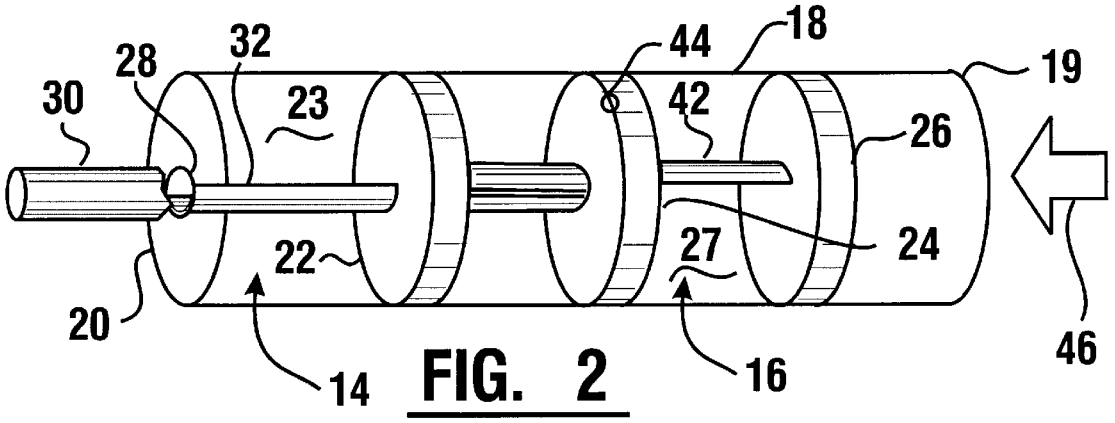
FIG. 2 is a view similar to that of FIG. 1 except the dispenser is in a partially dispensed position.
Figure 3:
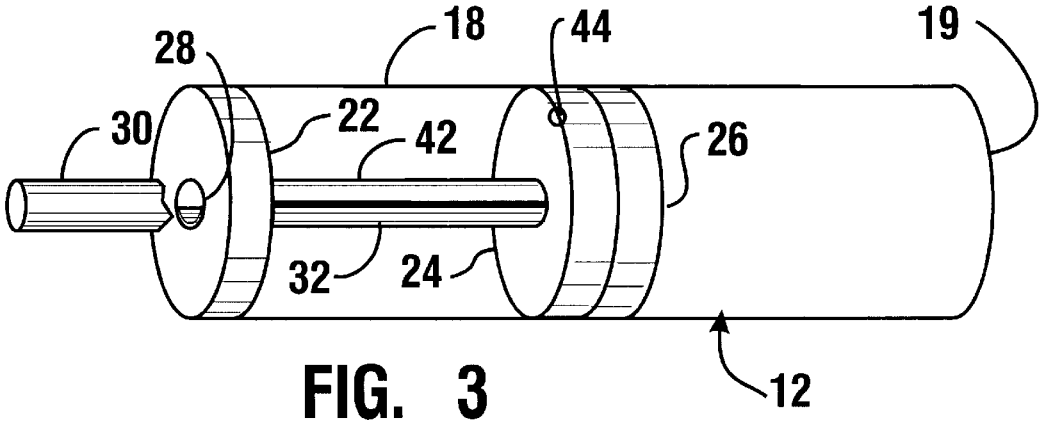
FIG. 3 is a view similar to FIGS. 1 and 2 except that the dispenser is in the empty position.

The second chamber 16 is in axial alignment within container 12 with the first chamber 14. Second chamber 16 is defined by the cylindrical side walls 18, a fixed front wall 24 and a rear wall 26. As mentioned earlier, cylindrical side walls 18 of container 12 terminate in an open rear end 19 behind the rear wall 26 of the second chamber 16 as best seen in FIGS. 1–3. Rear walls 22, 26 have an outside diameter that complements an inside diameter of the cylindrical walls 18 yet allow a relatively tight, but sliding engagement therein. Second chamber 16 in a similar fashion to the first chamber 14 has an interior volume or space for holding a second fluid product 27 that is maintained separate from the first fluid product 23. The first and second fluid products may be chemically reactive such as a resin and hardener, or an adhesive, potting compound, sealant, caulk, encapsulant, or the like. Similarly, in medical applications, the first and second fluid products may be biologically and/or chemically reactive, and/or provide a synergistic health benefit when dispensed substantially together.

The multi-component dispenser 10 of the present invention is particularly suited for containing and maintaining two separate chemically active products and subsequently dispensing the products at a desired ratio for producing an end product. Accordingly, container 12 including the front walls 20,24, side walls 18, and rear walls 22,26 are made from plastic, polymers, fluoroplastic material, glass or any other material like stainless steel or metal alloys that does not react with the fluid products contained therein.

The front wall 20 includes an opening 28 therethrough, preferably centrally located, with a nozzle 30 surrounding the opening 28. Preferably, nozzle 30 is also constructed of a chemically non-reactive material as previously mentioned and may even include a static mixer as described in U.S. Pat. No. 4,014,463 for mixing products uniformly as they pass through the nozzle. Nozzle 30 may even take the form of a needle when container 12 is a syringe. The term nozzle as employed herein is intended to encompass this medical application and is meant to be broadly construed to include syringe type and/or syringe nozzles or needles.

The first chamber 14 further includes a conduit 32 that extends therethrough in axial alignment with the opening 28. Conduit 32 is in fluid communication with nozzle 30 at a first end 34. A second end 36 of conduit 32 is in fluid communication with second chamber 16. Conduit 32 is attached to the front wall 24 and may be attached to and even extend into nozzle 30 if desired. It is firmly held in place by the fixed front wall 24 of second chamber 16 at its second end 36 and by the nozzle 30 at its first end 34. Conduit 32 may be formed as one piece with front wall 24 or may be manufactured separately and attached thereto with an adhesive or mechanically. Similarly, the first end 34 is secured in nozzle 30 or to the opening 28 of front wall 20 with an adhesive or mechanically.

Figure 4:
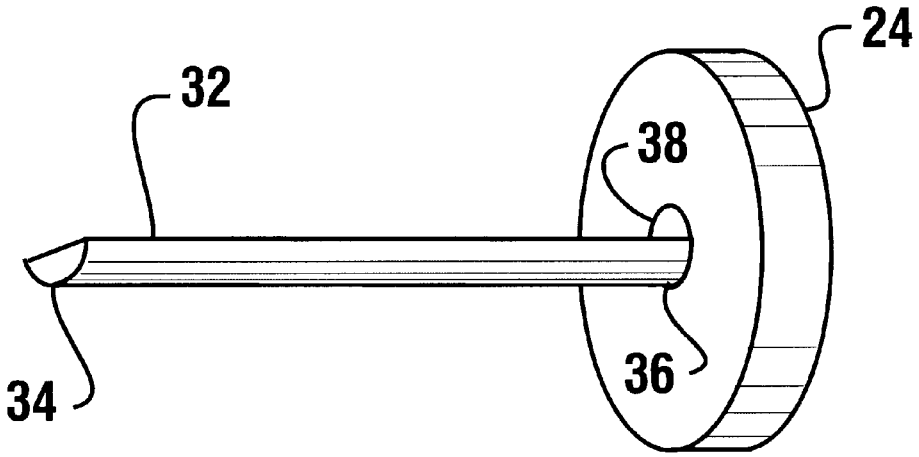
FIG. 4 is an elevated view of the conduit and front wall of the second chamber in accordance with the present invention.

Turning next to FIG. 4, conduit 32 preferably has a hollow semi-circular shape and is also constructed of a non-reactive material previously described. Conduit 32 is preferably centrally located and secured in front wall 24 of the second chamber 16 to allow fluid communication from the second end 36 of the conduit for discharge out its first end 34 via nozzle 30. Front wall 24 includes an opening 38 that is preferably centrally located therein adjacent to conduit 32 in a complementary generally semi-circular shape that when viewed from its back side would form generally a completed circle with the opening of conduit 32. Of course, opening 38 may be situated otherwise in front wall 24. Front wall 24 is fixed in a desired axial location within container 12 and is firmly held in place with an adhesive or mechanically. The term mechanically as used herein is intended to include but not be limited to a force-fit engagement, interference fit, threaded engagement or any other fastening means, or even welding.

Figure 5:
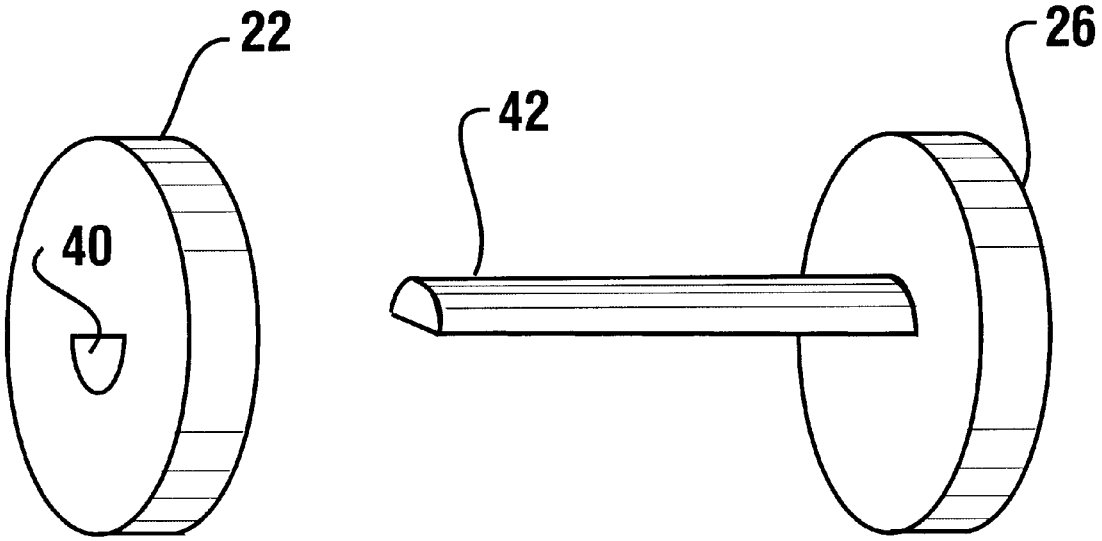
FIG. 5 is an elevated view of the rear wall of the first chamber, the extension member and rear wall of the second chamber in accordance with the present invention.

Turning next to FIG. 5, rear wall 22 of the first chamber 14 includes an aperture 40 which is preferably generally centrally located therein and has a semi-circular shape that complements the shape of conduit 32 so as to provide a relatively tight, sliding engagement therebetween. The rear wall 22 is constructed to slide on conduit 32 and its movement forward in a direction towards nozzle 30 pushes the first fluid 23 out opening 28 from first chamber 14. Rear wall 22 through its aperture 40 tightly engages conduit 32 so as to prevent any leakage, or limited leakage of the first fluid product 23.

Rear wall 26 of the second chamber 16 has an extension member 42 rigidly attached by suitable means thereto. Preferably, extension member 42 is constructed of a non-reactive material as previously described and is centrally located on rear wall 26 in axial alignment with opening 38 in the front wall 24 of the second chamber 16. Extension member 42 is constructed to provide a relatively tight sliding engagement as it passes through opening 38 when a linear force is applied to the rear wall 26. In this manner, very little if any of the second fluid product 27 leaks from opening 38.

Returning to FIG. 1, the multi-component dispenser is depicted in its full or initial position when the first chamber 14 is filled with the first fluid product 23 and the second chamber 16 is also filled with the second fluid product 27. In this initial position, extension member 42 fits relatively tightly within opening 38 to seal the second chamber 16 from the first chamber 14. As mentioned earlier, the rear walls 22, 26 and front wall 24 have an outside diameter that complements the inside diameter of the side walls 18 of container 12. Front wall 24 is constructed to be firmly held in place. Both rear walls 22, 26 provide a relatively tight but sliding engagement within container 12. Container 12 has a front wall 20 which is preferably integrally formed with container 12. Cylindrical side walls 18 of container 12 terminate in an open rear end 19 with rear wall 26 of the second chamber 16 effectively sealing off the back of the container 12. Preferably, rear walls 22, 26 are generally cup shaped with an outer periphery wall extending substantially perpendicular to the rear wall constructed of sufficient width for sealing the chambers. Additionally, the cup shaped periphery wall of rear wall 26 facilitates engagement of a plunger (not shown) for example from a caulking gun.

The multi-component dispenser 10 in accordance with the preferred embodiment of the present invention further provides a hole 44 through the side wall 18 preferably positioned between rear wall 22 and front wall 24 to allow air to flow into the void that forms upon separation. When the multi-component dispenser is filled, hole 44 allows air to be expelled from the container. Advantageously, hole 44 is situated between rear wall 22 of the first chamber 14 and the front wall 24 of the second chamber 16 so that when the multi-component dispenser 10 is in its filled position, hole 44 is sealed by the outer periphery wall of rear wall 22 and front wall 24.

Returning to FIG. 2, the multi-component dispenser 10 is shown in a partially filled state. When a linear force represented by arrow 46 is applied to rear wall 26, the second fluid product 27 from second chamber 16 is discharged out the first end 34 of conduit 32. In addition, extension member 42 synchronously pushes through opening 38 and forces the rear wall 22 of the first chamber 14 forward to discharge the first fluid product 23 out opening 28 into nozzle 30. In this manner the first fluid product 23 and second fluid product 27 are mixed within nozzle 30. Thus, relatively synchronous discharge of the fluid products from the first chamber 14 and the second chamber 16 is achieved through nozzle 30 with the use of conduit 32 and extension member 42. FIG. 3 shows the multi-component dispenser 10 in its fully discharged or empty position.

Figure 6:
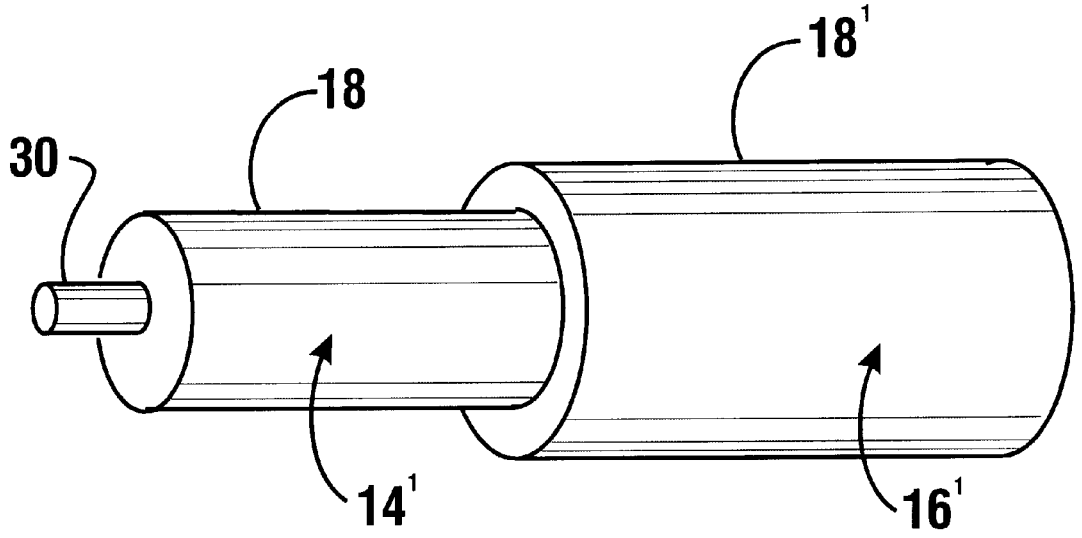
FIG. 6 is an elevated perspective view of an alternate embodiment of the present invention.

While the foregoing description depicts the multi-component dispenser 10 as being generally cylindrical and of approximately equal volumes, it should be immediately apparent that the configuration of the chambers as well as the internal volume may be changed to provide different ratios of the fluid products for dispensing as shown in FIG. 6. In FIG. 6, the diameter of the first chamber 14' is less than the diameter of the second chamber 16'. This configuration allows variable mix ratios that can be achieved and pre-calculated in desired amount in an alternative embodiment according to the present invention. The rear wall 22 of the first chamber and the front and rear walls 24,26 of the second chamber are configured to complement the cylindrical side walls for a tight, sliding engagement therein.

Advantageously, the design of the instant invention allows for the construction of more than two chambers if desired with the simple addition of front and rear walls and extension members as necessary. For example, a third fluid product could be provided in a third chamber by dividing conduit 32 in half and extending the divided portion of the conduit to continue through the second chamber 16. The conduit 32 would be in axial alignment with nozzle 30 and pass through an opening in the rear wall 26. The extended conduit would be attached to a front wall of a third chamber so that the divided partition of conduit 32 is in fluid communication with the third chamber. An additional extension member would be necessary and constructed in a similar fashion to extension member 42 for the second chamber to synchronously move the rear wall of the second chamber when a linear force is applied to the rear wall of the third chamber. In this fashion, as many chambers as desired could be constructed.

When used as a syringe type dispenser (a term meant to include syringes or the like), the rear wall 26 of the back chamber 16 could have an integral plunger (not shown) attached thereto and the side walls 18 at the rear of container 12 would have projections at the rear typical for a syringe. The syringe could be made of glass, plastic, fluoroplastic, or even stainless steel or other suitable metal alloy. Rear walls 22,26 may include a rubber covering and/or periphery for facilitating suction and injection of the fluid products.

This flexibility in design provides a multi-component dispenser which can be produced in relatively large quantities and relatively inexpensively. The front and rear wall components may be manufactured separately or as subassemblies for simple fabrication and assembly. As an example, extension member 42 and rear wall 26 may be formed as a unit. Likewise, conduit 32 and front wall 24 may be formed as a unit or subassembly. Of course, these components may also be manufactured separately. This enables the multi-component dispenser in accordance with the present invention to be a throw away item similar to tubes of caulk or disposable syringes. It is equally envisionable that the multi-component dispenser can be made from a material such as stainless steel, glass, plastic, fluoroplastic or any suitable metal or alloy that does not chemically react with the fluid products contained therein and then simply cleaned for subsequent refilling.

Thus, the present invention achieves the above-stated objectives eliminates difficulties encountered with the use of the prior art devices, solves problems and attains the desirable results described herein.

In the foregoing description, certain terms have been used for brevity, clarity and understanding. However, no unnecessary limitations are to be implied therefrom, because such terms are for descriptive purposes and are intended to be broadly construed. Moreover, the descriptions and illustrations herein are by way of examples and the invention is not limited to the details shown and described. Further, in the following claims any feature that is described as a means for performing a function shall be construed as encompassing any means capable of performing that function and shall not be limited to the particular means shown in the foregoing description or mere equivalents.

Having described the features, discoveries and principles of the invention, the manner in which it is constructed and operated, and the advantages and usefull results attained, the new and useful structures, devices, elements, arrangements, parts, combinations, systems, equipment, operations and relationships are set forth in the appended claims.

I claim:

1. A multi-component dispenser, comprising:

a container having at least a first and a second chamber in axial alignment, each of said chambers having an interior volume being defined by a front wall, side walls, and a slidably movable rear wall;

a nozzle attached to said front wall of said first chamber, said nozzle surrounding an opening in said front wall of said first chamber;

a conduit situated in said first chamber, said conduit having a first end positioned for discharge in said nozzle, and a second end fluidly connected to the second chamber through the front wall of the second chamber, said conduit being positioned in axial alignment with said nozzle, the rear wall of said first chamber having an aperture constructed to slidably engage said conduit for movement thereon, the rear wall of said first chamber having an initial position adjacent to the front wall of said second chamber, the front wall of said second chamber further including an opening; and an extension member attached to the rear wall of said second chamber, said extension member being axially aligned with and sealing the opening in the front wall of said second chamber and constructed to pass therethrough with a sliding contact engagement upon forward movement of the rear wall of said second chamber, whereby forward movement of the rear wall of said second chamber pushes said extension member forward to provide substantially synchronous movement of said rear wall of said first chamber for discharging a first fluid product contained within said first chamber out of said nozzle generally simultaneously with a second fluid product contained within said second chamber passing through said conduit out from said nozzle.

2. A multi-component dispenser according to claim 1, wherein said container has a substantially cylindrical shape.

3. A multi-component dispenser according to claim 1, wherein said side wall of said container includes an opening therethrough for allowing air to flow therein.

4. A multi-component dispenser according to claim 3, wherein said opening is located between the rear wall of said first chamber and said front wall of said second chamber for allowing air to flow therebetween upon separation.

5. A multi-component dispenser according to claim 2, wherein said first chamber has a diameter less than said second chamber.

6. A multi-component dispenser according to claim 2, wherein said second chamber has a diameter less than said first chamber.

7. A multi-component dispenser according to claim 1, wherein said conduit has a semi-circular shape.

8. A multi-component dispenser according to claim 7, wherein the opening in the front wall of said second chamber is semi-circular in shape and centrally located therein.

9. A multi-component dispenser according to claim 8, wherein said extension member has a semi-circular shape for sliding contact and engagement through the opening in the front wall of said second chamber.

10. A multi-component dispenser according to claim 9, wherein said extension member is hollow.

11. A multi-component dispenser according to claim 9, wherein said extension member is solid.

12. A multi-component dispenser according to claim 1, wherein said conduit is positioned coaxially within said nozzle.

13. A multi-component dispenser according to claim 2, wherein said first chamber and said second chamber are approximately equal in diameter.

14. A multi-component dispenser according to claim 1, wherein said nozzle is a static mixer nozzle.

15. A multi-component dispenser according to claim 1, wherein said rear walls include an outer periphery wall for facilitating sealing.

16. A multi-component dispenser according to claim 1, wherein the front wall of said second chamber is rigidly attached to the side walls at a desired location within said container.

17. A multi-component dispenser according to claim 1, wherein said container, the front and rear walls, the side walls, said nozzle, said conduit, and said extension member are formed from a material selected from the group consisting of glass, a plastic, a fluoroplastic material, a polymer, stainless steel, and an alloy.

18. A multi-component dispenser according to claim 1, wherein said conduit and the front wall of the second chamber are formed integrally.

19. A multi-component dispenser according to claim 1, wherein said extension member and the rear wall of the second chamber are formed integrally.

20. A multi-component dispenser according to claim 1, wherein said container is a syringe type dispenser.

* * * * *